US006823570B1

(12) United States Patent
Huang

(10) Patent No.: US 6,823,570 B1
(45) Date of Patent: Nov. 30, 2004

(54) METHOD FOR MANUFACTURING WET ABSORPTION YARNS AND WET ABSORPTION YARNS MADE FROM THE METHOD

(76) Inventor: Tsu-Ming Huang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/672,565

(22) Filed: Sep. 29, 2003

(51) Int. Cl.[7] ..... D02J 3/04

(52) U.S. Cl. ..... 28/220; 28/247; 28/28; 28/258

(58) Field of Search ..... 28/220, 247, 258, 28/219, 240, 178, 169, 252; 57/286, 295, 310, 332, 351; 118/75, 230, 244; 427/299, 401, 428

(56) References Cited

U.S. PATENT DOCUMENTS 3,470,685 A * 10/1969 Hall et al. ..... 428/85
3,645,080 A * 2/1972 Yamagata et al. ..... 57/2
3,724,198 A * 4/1973 Kim ..... 57/260
3,822,543 A * 7/1974 Edagawa et al. ..... 57/5
3,862,853 A * 1/1975 Benson ..... 427/428
4,036,003 A * 7/1977 Lowder et al. ..... 57/260
4,439,903 A * 4/1984 Matsumoto et al. ..... 28/258
5,613,285 A * 3/1997 Chester et al. ..... 28/247

* cited by examiner

*Primary Examiner*—A. Vanatta

(57) ABSTRACT

A method for manufacturing wet absorption yarns comprises the following steps of fabricating the polypropylene filaments into yarns; feeding the yarns to a false twisting machine for twisting the yarns; feeding the yarns to a driving roller and a package rollers for twisting the yarns to be as twisting yarns; transferring the twisting yarns to at least one brush roller with short brushes on the surface of the roller so that hairs are formed on the twisting yarns to be as haired twisting yarns; feeding the haired twisting yarns to at least one grooved roller; feeding the haired twisting yarns to at least one guiding wheel to be stretched and drying the haired twisting yarns; and outputting the haired twisting yarns as wet absorption yarns. Moreover, a wet absorption yarns is disclosed, where wet absorption yarns made from polypropylene filaments. The wet absorption yarns is twisted, haired and permeated with wet absorber.

3 Claims, 2 Drawing Sheets

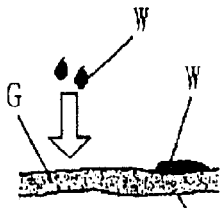
Fig. 1
Prior Art
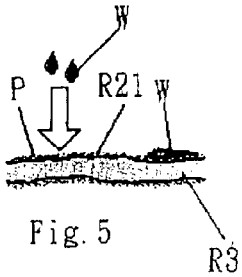
Fig. 5
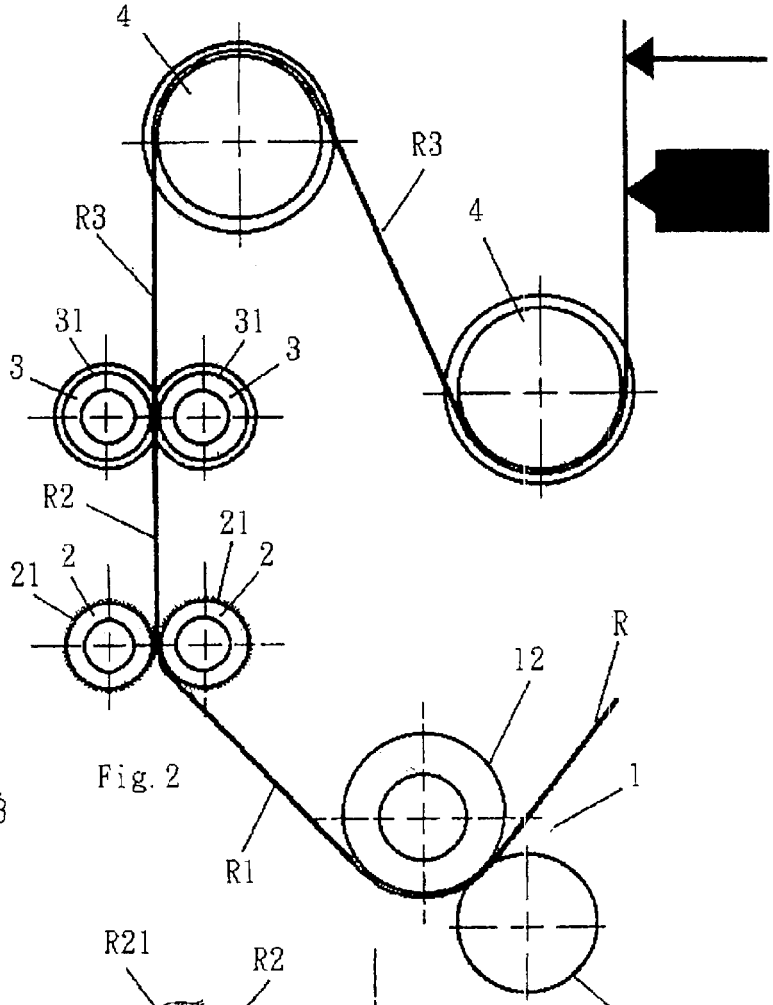
Fig. 2
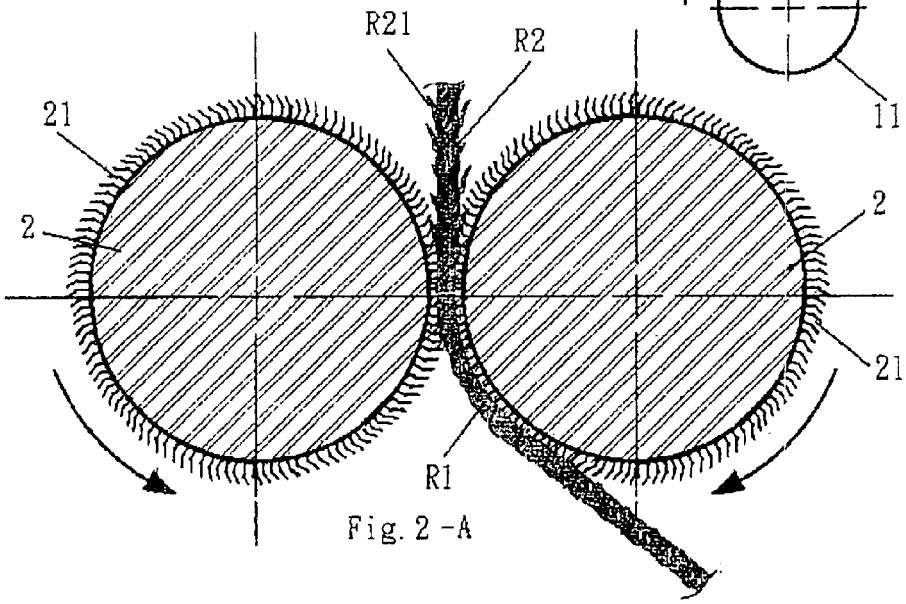
Fig. 2 -A

METHOD FOR MANUFACTURING WET ABSORPTION YARNS AND WET ABSORPTION YARNS MADE FROM THE METHOD

BACKGROUND OF THE INVENTION

1) Field of the Invention

The present invention relates to wet absorption yarns, and in particular to method for manufacturing wet absorption yarns and the yarns manufactured from the method.

2) Description of the Prior Art

Conventionally, wet absorption fabrics are made by modifying the structure of the fabrics or permeating wet absorber into fabrics or yarns so that the fabrics have the function of absorbing water and thus the fabrics have many functions, such as wiping, absorbing sweat of the body and thus draining the sweat from the body.

Conventionally, adding wet absorber to fabrics likes the dying process. The yarns or fabrics are sunk in wet absorber or sputtered with wet absorber. The difficult of this process is that the adding process is completely isolated from other manufacturing process of the fabrics. In the process, the manufacturers must transfer, sink (or sputter), drying the yarns or fabrics. These extra steps make the process to be time and labor consumed so that the cost of the yarns or fabrics is expensive.

Moreover, the sputtering process induces a weak fastness, while the sinking process will induce that too much wet absorber is permeated into the yarns or fabrics so that too much of the wet absorber is used and a longer time is required to dry the yarns or fabrics. Moreover, the products are hard so that a bad feeling is presented.

SUMMARY OF THE INVENTION

Accordingly, the primary object of the present invention is to provide a method for manufacturing wet absorption yarns. The method comprises the following steps of fabricating the polypropylene filaments into yarns; feeding the yarns to a false twisting machine for twisting the yarns; feeding the yarns to a driving roller and a package rollers for twisting the yarns to be as twisting yarns; transferring the twisting yarns to at least one brush roller with short brushes on the surface of the roller so that hairs are formed on the twisting yarns to be as haired twisting yarns; feeding the haired twisting yarns to at least one grooved roller; feeding the haired twisting yarns to at least one guiding wheel to be stretched and drying the haired twisting yarns; and outputting the haired twisting yarns as wet absorption yarns. Moreover, a wet absorption yarns is disclosed, where wet absorption yarns made from polypropylene filaments. The wet absorption yarns is twisted, haired and permeated with wet absorber.

The various objects and advantages of the present invention will be more readily understood from the following detailed description when read in conjunction with the appended drawing.

BRIEF DESCRIPTION OF THE DRAWINGS

FIG. 1 is a schematic view of prior art wet absorption yarns.

FIG. 2 shows the flow of the present invention.

FIG. 2-A is an enlarged cross section view of the brushed roller of the present invention.

FIG. 3-A is a lateral view of FIG. 3.

FIG. 3-B is an enlarged view is the haired twisting yarns with wet absorber according to the present invention.

FIG. 4-A shows a lateral view of FIG. 4.

FIG. 5 is a schematic view showing the wet absorption yarns of the present invention.

DETAILED DESCRIPTION OF THE INVENTION

Figure 3:
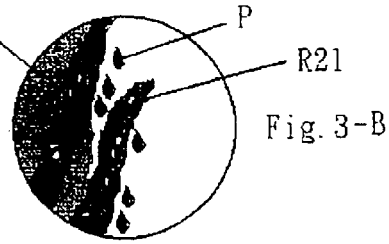
FIG. 3 is an enlarged cross section view of the grooved roller of the present invention.
Figure 3:
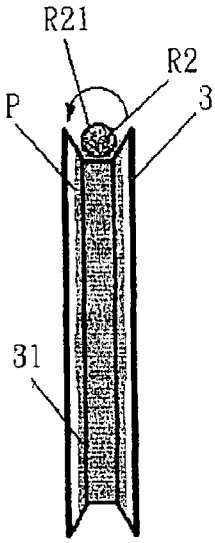
Figure 3:
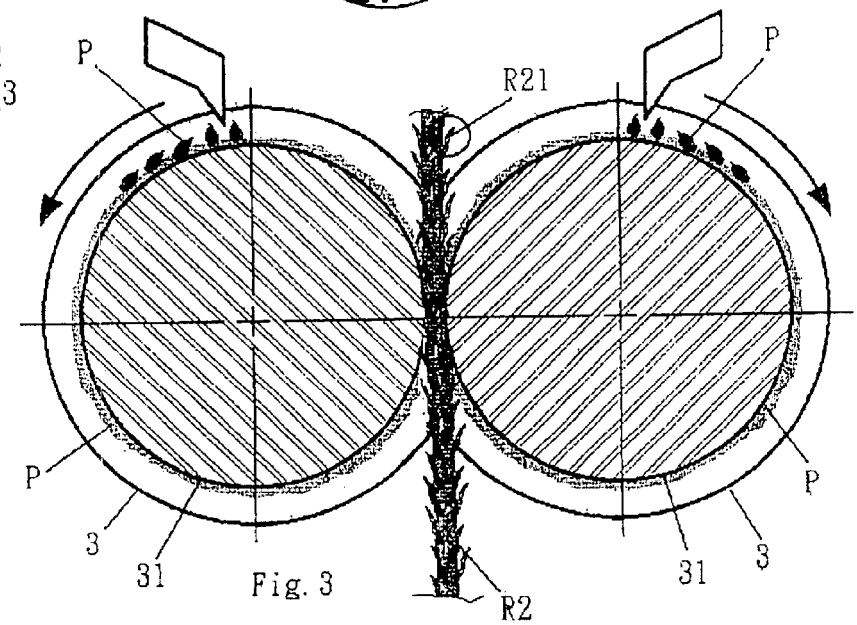

Referring to FIG. 2, the method of manufacturing wet yarns and the product from the same are illustrated. The yarns are made from polypropylene filaments without capillary pores thereon. The method comprises the following steps of:

Fabricating the polypropylene filaments into yarns;

Feeding the yarns to a false twisting machine for twisting the yarns.

Feeding the yarns to a driving roller 11 and a package roller 12 for twisting the yarns to be as twisting yarns R1.

Transferring the twisting yarns R1 to at least one brush roller 2 with short brushes on the surface of the roller 2 so that hairs are formed on the twisting yarns R1 so as to be as haired twisting yarns R2 (referring to FIG. 2-A).

Next, feeding the haired twisting yarns R2 to at least one grooved roller 3.

Next, feeding the haired twisting yarns R2 to at least one guiding wheel 4 to be stretched and drying the haired twisting yarns R2, and then outputting the haired twisting yarns as wet absorption yarns R3.

In the bottom 31 of a trench of the grooved roller 3 is placed wet absorber P. When the haired twisting yarns R2 passes through the grooved roller 3; the wet absorber P will permeate into hairs R2, of the haired twisting yarns R2 (referring to FIG. 3B). The wet absorber P will be completely adhered to the yarns in the following stretching process (referring to FIG. 5). Thereby, cloth made of this wet absorption yarns R3 will have functions of water absorption and draining.

From above FIGS. 3, 3-A and 3-B, the wet absorber P is uniformly coated on a surface of the bottom 31 of the grooved roller 3. The haired twisting yarns R2 is fed into the grooved roller continuously so that the wet absorber P in the bottom 31 will be coated on the haired twisting yarns R2 from the upper side of the haired twisting yarns R2.

Figure 4:
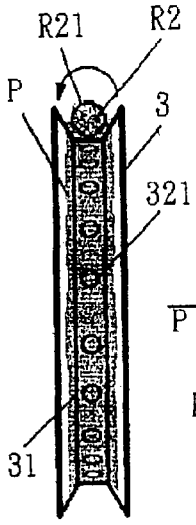
FIG. 4 is another enlarged cross section view of the grooved roller of the present invention.
Figure 4:
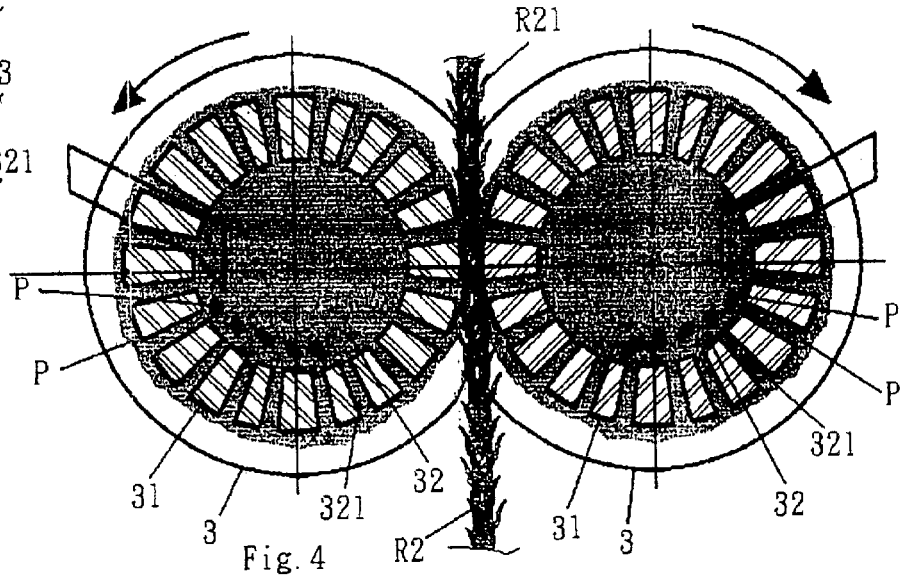

Moreover, as shown in FIGS. 4 and 4-A, a material inlet 32 is formed at a center of the grooved roller. A plurality of penetrating holes 321 are formed around the material inlet 32 so that the wet absorber P can be fed into the material inlet 32. With the rotation of the grooved roller, the wet absorber P will flow to a surface of the bottom 31 of the grooved roller so as to coat on the haired twisting yarns R2 continuously.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method for manufacturing wet absorption yarns comprises the following steps of fabricating polypropylene filaments into yarns;

feeding the yarns to a false twisting machine for twisting the yarns;

feeding the yarns to a driving roller and a package roller for twisting the yarns to be as twisting yarns;

transferring the twisting yarns to at least one brush roller with short brushes on the surface of the roller so that hairs are formed on the twisting yarns to be as haired twisting yarns;

feeding the haired twisting yarns to at least one grooved roller;

feeding the haired twisting yarns to at least one guiding wheel to be stretched and drying the haired twisting yarns; and outputting the haired twisting yarns as wet absorption yarns.

2. The method for manufacturing wet absorption yarns as claimed in claim 1, wherein a bottom of a trench of the grooved roller is placed with wet absorber; when the haired twisting yarns passes through the grooved roller, the wet absorber permeates into hairs of the haired twisting yarns; and then the wet absorber is completely adhered to the yarns in the following stretching and drying steps.

3. The method for manufacturing wet absorption yarns as claimed in claim 1, wherein a material inlet is formed at a center of the grooved roller; a plurality of penetrating holes are formed around the material inlet to communicate the material inlet and the bottom of the grooved roller so that wet absorber is fed into the material inlet; with the rotation of the grooved roller, the wet absorber will flow to a surface of the bottom of the grooved roller so as to coat on the haired twisting yarns continuously.

* * * * *